US006216511B1

(12) United States Patent
Ohnishi et al.

(10) Patent No.: US 6,216,511 B1
(45) Date of Patent: Apr. 17, 2001

(54) APPARATUS AND METHOD FOR SMOOTHING A WELDED SEAM OF STEEL PIPE

(75) Inventors: Toshio Ohnishi; Masahiro Kagawa, both of Aichi; Yoshnori Sugie, Tokyo; Koji Sugano, Aichi; Nobuki Tanaka, Aichi; Kingo Sawada, Aichi; Masao Shoji, Aichi; Takaaki Toyooka, Aichi; Yuji Hashimoto, Aichi; Motoaki Itadani, Aichi; Akira Yorifuji, Aichi; Masanori Nishimori, Aichi, all of (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/049,193

(22) Filed: Mar. 27, 1998

(30) Foreign Application Priority Data

Mar. 28, 1997 (JP) ..... 9-076939
Aug. 25, 1997 (JP) ..... 9-228578

(51) Int. Cl.[7] ..... B21D 51/28; B21D 1/08; B21B 17/02

(52) U.S. Cl. ..... 72/113; 72/208; 72/370.01; 72/52

(58) Field of Search ..... 72/113, 51, 52, 72/97, 150, 193, 208, 209, 370.01, 201, 200, 202; 228/125

(56) References Cited

U.S. PATENT DOCUMENTS 278,340 * 5/1883 Kellogg ..... 72/113
3,455,137 * 7/1969 Edgecombe ..... 72/342.3
3,729,124 4/1973 Kedzior et al. .
3,797,297 * 3/1974 Wightman et al. ..... 72/113
4,072,035 2/1978 Ziemek et al. .

FOREIGN PATENT DOCUMENTS 0 812 633 12/1997 (EP) .
58-199624 * 11/1983 (JP) ..... 72/113
62-197300 8/1987 (JP) .
2-299782 12/1990 (JP) .
776701 * 11/1980 (SU) ..... 72/113

* cited by examiner

*Primary Examiner*—Rodney A. Butler
(74) *Attorney, Agent, or Firm*—Young & Thompson

(57) ABSTRACT

A method and apparatus for smoothing a thick walled portion of a steel pipe produced by pressure-welding two opposite longitudinal edges of an open pipe with a squeeze roll after being subjected to induction heating. Outer and inner reduction rollers pressure sandwiches the thick walled portion from the outer and inner surfaces of the pipe, a support supports the inner reduction roller to be rotatable and containing a water passage for cooling water, a connecting rod connects the support device to a coupler and contains a further water passage for feeding cooling water to the water passage, and an anchor holds the connecting rod. In the a method of producing steel pipes two opposite longitudinal edges of the open pipe are preformed before being subjected to the induction heating and thereafter a thick walled portion is smoothed by the above-described apparatus.

13 Claims, 9 Drawing Sheets

H : HEIGHT WHEN CRACKING OCCURS IN SEAM WELDED PORTION

D : OUTSIDE DIAMETER BEFORE COMPRESSION h/D : FLATNESS HEIGHT RATIO

APPARATUS AND METHOD FOR SMOOTHING A WELDED SEAM OF STEEL PIPE

BACKGROUND OF THE INVENTION

1. Field of the Invention

The present invention relates to an apparatus and a method for smoothing a welded seam of a steel pipe. More particularly, the present invention relates to a method and apparatus for smoothing a welded seam of steel pipe by successively subjecting a steel strip in a welded pipe production line to cylindrical shaping with a forming roll to form an open pipe, and smoothing in the production line a thick walled portion of the pipe that has been pressure-welded in a proper temperature range of solid-phase pressure-welding.

2. Description of the Related Art

Welded steel pipes are produced by subjecting a steel sheet or a steel strip to cylindrical shaping and then to seam welding. Methods of producing such steel pipes can be roughly divided into electric resistance welding, forge welding, and electric arc welding according to outside diameters and uses.

Steel pipes having small to medium outside diameters are produced by an electric resistance welding method utilizing high-frequency induction heating. This welding method is devised to cylindrically form a steel strip with a forming roll into an open pipe that is then heated at ends of two opposite longitudinal edges by means of high-frequency induction heating at a temperature above the melting point of the steel. Those opposed end faces of the open pipe are subsequently butt-welded with a squeeze roll to form an electric resistance welded steel pipe. See, for example, Vol. 3 (3) pp. 1056 to 1092 of the third edition of Handbook of Steel.

One of the problems with this method is that when the opposite longitudinal edges of the open pipe are heated to a temperature higher than the melting point of the steel, molten steel flows under the influence of electromagnetic force forming an oxide that invades the welded seam. This has a tendency to or causes weld defects and molten steel splashes.

In order to overcome this problem, a method of producing an electric resistance welded steel pipe having two heaters is proposed in Japanese Unexamined Patent Publication No. 2-299782. A first heater heats opposite longitudinal edges of an open pipe to a temperature higher than the Curie point, and a second heater further heats the edges to a temperature higher than the melting point of the steel. Thereafter, two opposite longitudinal edges are butt-welded by a squeeze roll provided immediately downstream of the heaters to produce a steel pipe. In addition, Japanese Unexamined Patent Publication No. 2-299783 proposes an apparatus for producing an electric resistance welded steel pipe in which two opposite longitudinal edges of an open pipe are preheated with a current of a 45 to 250 kHz frequency applied by a first heater, and then two opposite longitudinal edges are further heated to a temperature higher than the melting point of the steel by a second heater and butt-welded with a squeeze roll.

These methods of producing electric resistance welded pipes teach heating two opposite longitudinal edges of the open pipe in a uniform manner, but the resulting flow of molten steel suffer may cause beads to form on inner and outer surfaces of the pipe during butt-welding because two opposite longitudinal edges of the open pipe are heated to a temperature higher than the melting point of the steel. The beads on the inner and outer surfaces should be removed after butt-welding. This removal is usually conducted by the use of a bead-cutting tool.

However, the bead-cutting tool causes additional problems. The time needed to replace the bead-cutting tool can be long due to adjustments in the amount to be cut, and wear or damage to the bead-cutting tool. This problem is especially severe when producing pipe at a high speed exceeding 100 m/min, which reduces the life of the bead-cutting tool and thus forces frequent replacement. For this reason, the pipe production line may be unproductive for prolonged periods.

Consequently, bead cutting imposes a bottleneck on production of welded steel pipes and prevents higher productivity.

On the other hand, a highly productive method of making a forge-welded steel pipe is also known to be suited for the formation of a steel pipe of a relatively small diameter. This method heats a successively supplied steel strip to a temperature about 1,300° C. in a heating furnace and thereafter subjects the steel strip to cylindrical forming with a forming roll into an open pipe. High-pressure air is sprayed on two opposite longitudinal edges of the open pipe to descale the edges, and then oxygen is sprayed onto the edges with a welding horn. The temperature of the edges is increased to about 1,400° C. by the oxidation heat and thereafter the edges are butt-welded and solid-phase welded by a forge welding roll to form a steel pipe. See, for example, Vol. III (3), pp. 1093 to 1109 of the third edition of Handbook of Steel.

However, this method is not without problems. Since the two opposite longitudinal edges of the open pipe surfaces are not sufficiently descaled, scales get into the butt-welded portion, and the strength of the seam is considerably inferior to that of the base material. For example, the electric resistance welded steel pipe achieves a flatness-height ratio h/D of 2t/D (with reference to FIG. 12, h is the height of the pipe when cracking occurs in the welded seam when the pipe is compressed and D is the outside diameter before compression, and where t is steel thickness), whereas the forge welded steel pipe can achieve a flatness-height ratio h/D of only about 0.5. In addition, the steel strip is heated to a high temperature, so that scales are produced on the surface of the pipe, thereby degrading the surface texture.

The forge welding method has a higher productivity than the electric resistance welding method due to its high pipe producing speed of 300 m/min or higher, but has poor seam quality and surface texture. For this reason, the forge welded steel pipe cannot be applied to a steel pipe requiring high strength reliability and surface quality, such as STK of JIS (Japanese Industrial Standards) or the like. In order to solve the above problems, the present inventors have devised a solid-phase pressure-welding pipe production method. In this method, two opposite longitudinal edges of the open pipe is subjected to induction heating (hereinafter, referred to as edges preheating) in the temperature range (hereinafter, referred as the preheating temperature range) higher than the Curie point (about 770° C.) but below the melting point of the pipe. Then, a uniform temperature of two opposite longitudinal edges is ensured within the preheating temperature range by air cooling and thereafter two opposite longitudinal edges of the open pipe are pressure-welded by being subjected to the induction heating (hereinafter, referred to as the real heating) in a proper temperature range of solid-phase pressure-welding (1,300 to 1,500° C.). The steel pipe produced by the solid-phase pressure-welding pipe production method requires no bead cutting unlike the conventional welded pipe, so that it can be produced by high pipe producing speed and has high productivity, and more over, causes no deterioration in the seam quality and surface texture due to oxidation. As shown in FIG. 11, however, a thick walled portion 6 that protrudes 5% or more of the thickness of the pipe 4 may be generated on a welded seam 5 of a solid-phase pressure-welded steel pipe 4 due to the temperature of the edges or degree of squeezing by the squeeze roll. Thick walled portion 6 is undesirable because it degrades the workability of the welded steel pipe, such as screw cutting, and promotes thickness deviation, such as inner surface angularity when squeeze-rolling the steel pipe.

SUMMARY OF THE INVENTION

It is an object of the present invention to provide an apparatus and a method for smoothing a welded seam of steel pipe that effectively smooths a thick walled portion of a steel pipe produced by a solid-phase pressure-welding pipe production method.

The present invention has been completed by the following consideration.

In the conventional electric resistance welded steel pipe, two opposite longitudinal edges of the open pipe are heated by means of induction heating at a temperature higher than the melting point, so that molten steel is discharged onto the inner and outer surfaces of the pipe during butt-welding to form beads. The beads are removed by a bead-cutting tool.

In contrast, according to the present invention, two opposite longitudinal edges of the open pipe are heated by means of induction heating in a temperature below the melting point, and then pressure-welded by a squeeze roll. A thick welded portion formed on a weld seam can be collapsed by rolls because it is not melted. However, when the beads of the conventional electric resistance welded steel pipe are to be collapsed by the rollers, the beads are adhered to the rollers to prevent the rotation thereof, making it impossible to remove the beads by collapsing.

Accordingly, an embodiment of the apparatus of the present invention includes outer and inner reduction rollers for smoothing the thick walled by applying pressure to outer and inner surfaces of the pipe, a support for supporting the inner reduction roller to be rotatable and containing a water passage for cooling water, a connecting rod for connecting the support to a coupler and containing a further water passage for feeding cooling water to the water passage, and an anchor for holding the connecting rod.

An embodiment of the method of the present invention includes the steps of successively subjecting a steel strip to shaping with a forming roll to obtain an open pipe, heating two opposite longitudinal edges of the open pipe to a temperature range below the melting point by induction heating, and pressure-welding two opposite longitudinal edges of the open pipe with a squeeze roll, and thereafter, smoothing the thick walled portion with the above apparatus.

Other features and objects of the present invention will be apparent to those of skill in the art from the following description of preferred embodiments when read in light of the accompanying drawings.

DESCRIPTION OF PREFERRED EMBODIMENTS

Figure 1A:
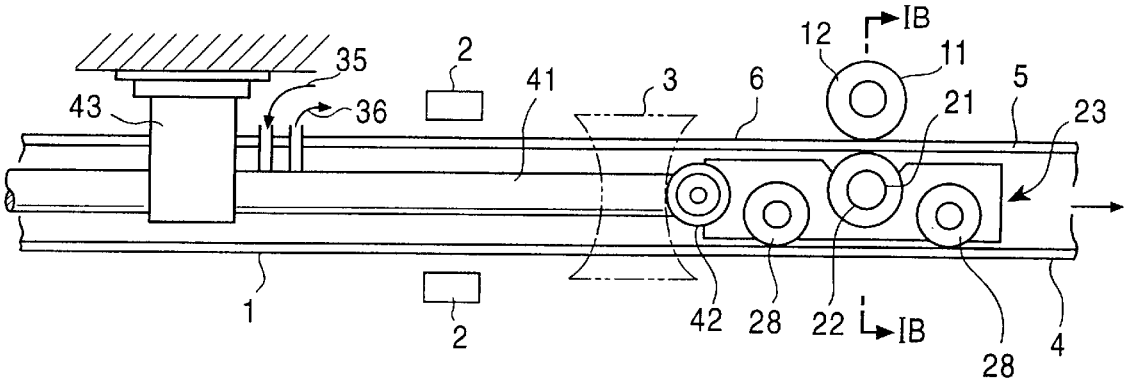
FIG. 1A is a schematic side sectional view showing a smoothing apparatus according to a first embodiment of the present invention.
Figure 1B:
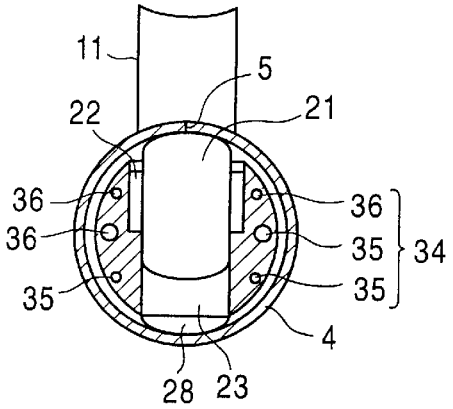
FIG. 1B is a front sectional view of FIG. 1A taken along the line IB—IB.

A basic smoothing apparatus according to a first embodiment of the present invention will be described with reference to FIGS. 1A and 1B. FIG. 1A illustrates the thick walled portion 6 being smoothed, in which two opposite longitudinal edges of open pipe 1 formed by subjecting a steel strip to cylindrical shaping are induction-heated by work coil 2 and then pressure-welded by squeeze roll 3 to form steel pipe 4.

An embodiment of the present invention includes an outer reduction roller 11 and an inner reduction roller 21 for smoothing thick walled portion 6 by pressure sandwiching outer and inner surfaces of the pipe, a support device 23 for supporting inner reduction roller 21 to be rotatable and containing a water passage 34 for cooling a cooling liquid (typically water, although other suitable liquids may be used), a connecting rod 41 for connecting support device 23 to a coupler 42 and feeding the cooling water to water passage 34, and an anchor 43 for holding connecting rod 41.

Figure 2:
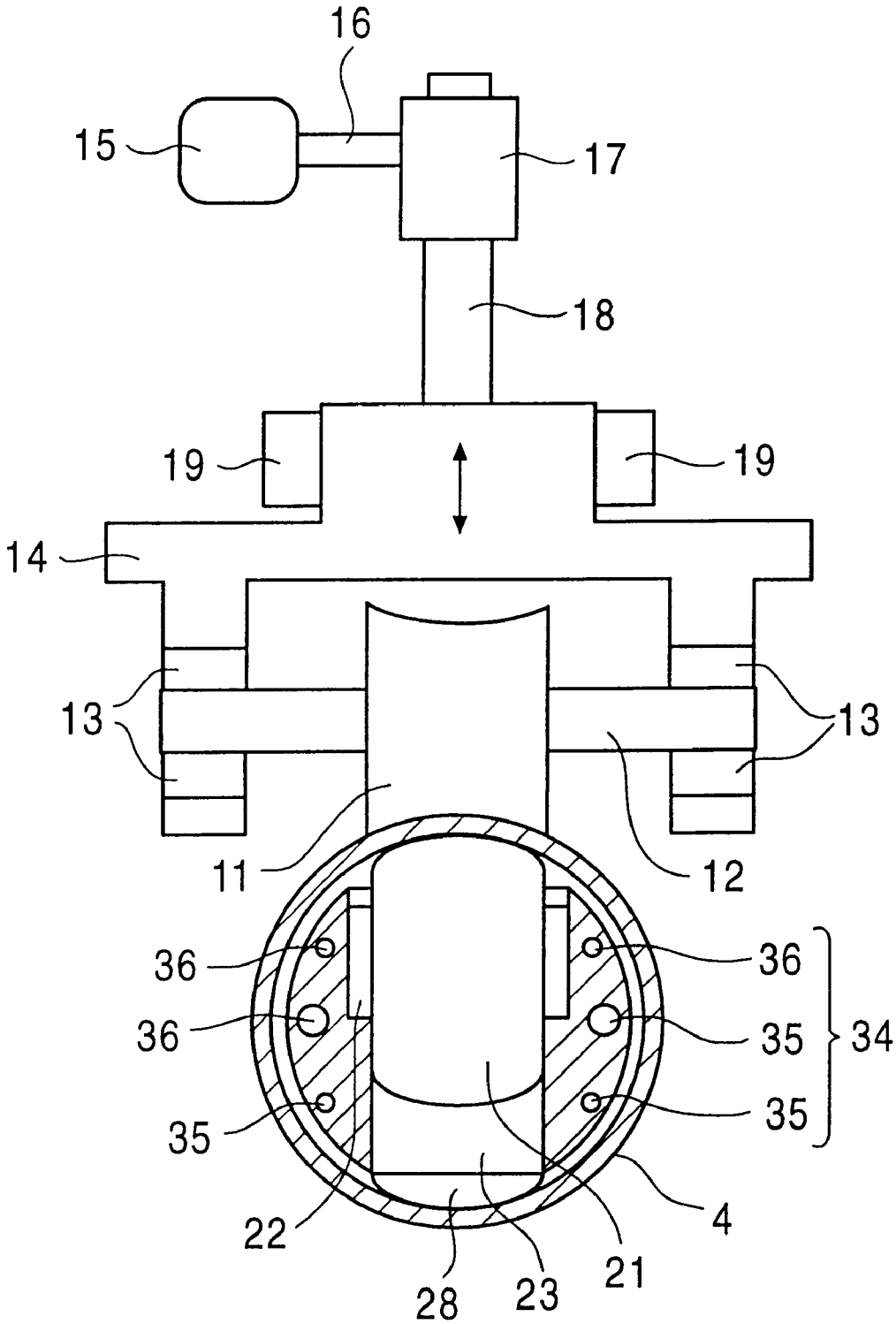
FIG. 2 is a schematic front sectional view showing a smoothing apparatus according to a second embodiment of the present invention.

With further reference to FIG. 2, outer reduction roller 11 is rotatably fitted to a support frame 14 by shaft 12 to contact the outer surface of steel pipe 4. Inner reduction roller 21 is rotatably fitted to support device 23 by roller pin 22 to come into contact with the inner surface of steel pipe 4. Support device 23 contains water passage 34 for feeding cooling water. Water passage 34 may include advance passages 35 and return passages 36. Cooling water may be oil or cooling medium. In addition, support device 23 has receiving rollers 28 at its lower portion for receiving a rolling reaction force of inner reduction roller 21 by abutment with the inner surface of the pipe. Receiving rollers 28 may be shoes. Connecting rod 41 is located upstream of a pipe production line by means of coupler 42 connected to support device 23 at its front end and fitted to anchor 43 outside of open pipe 1 at its rear end. Connecting rod 41 includes an extension of water passage 34 that is connected to water passage 34 in support device 23 through coupler 42.

A second embodiment of the smoothing apparatus according to the present invention will now be described with further reference to FIG. 2. The apparatus of this embodiment can control the upward and downward movement of outer reduction roller 11.

Outer reduction roller 11 is rotatably fitted to support frame 14, which is provided on the outer surface of steel pipe 4, through shaft 12 and bearings 13. Further, outer reduction roller 11 can be moved up and down by a motor 15, a motor shaft 16, a jacking section 17, a screw shaft 18 and a sliding section 19 placed on support frame 14. Inner reduction roller 21 may have the same construction as that of the first embodiment.

A third embodiment of the smoothing apparatus according to the present invention will be described with reference to FIGS. 3 and 4. The apparatus of this embodiment can control the up and down movement of inner reduction roller 21.

Support device 23 consists of a frame portion 25 for supporting bearing 24, and a rod 26 portion extending toward open pipe 1 which are connected by a joint 27. Anchor 43 fitted near the tail end of rod portion 26 is passed through a slit in open pipe 1 to be affixed outside of the open pipe 1, whereby support device 23 is held at a predetermined position in open pipe 1. The position is such that inner reduction roller 21 and outer reduction roller 11 can be located on opposite sides of the thick walled portion 6.

On the other hand, bearing 24 is connected to the connecting rod 41 through a link mechanism 29. Link mechanism 29 includes a link arm 30 supported by frame portion 25 so as to be axially slidable in the pipe, and a link lever 31 for linking link arm 30 and bearing 24 through movable pins 33 on both ends thereof. The length of link lever 31 is designed and both of movable pins 33 are placed so that the displacement of link arm 30 in the pipe axial direction is converted into a radial displacement of bearing 24 toward outer reduction roller 11. Bearing 24 is connected to the tip of connecting rod 41 at the tail end of link arm 30.

Connecting rod 41 is passed through rod portion 26 to be connected to a rolling force generator 44 at its tail end. Although the invention may use other conventional force generators, rolling force generator 44 is preferably a hydraulic cylinder affixed outside of the pipe. An L-shaped lever 46 secured at its center portion by a fixed pin 48 may be provided at a position between a cylinder rod 45 and the tail end of connecting rod 41 where it passes through the slit portion of open pipe 1. Then, one end of L-shaped lever 46 may be secured to cylinder rod 45 by movable pin 49 and the other end is secured to the tail end of the connecting rod 41 by further movable pins 49 through an auxiliary arm 47.

Rolling force generator 44 may also be an electric motor, an air cylinder, etc. In the case of the electric motor, a convertor for converting rotational action of the rotary shaft of the motor into reciprocating action is additionally required. Such a convertor may be easily constructed by the use of a known mechanical component, such as a crank.

With this arrangement, the rolling force generated in rolling force generator 44 causes connecting rod 41 to be displaced in the pipe axial direction, and the displacement is converted by link mechanism 29 into the displacement of bearing 24, i.e., the displacement of inner reduction roller 21 in the up and down direction of the drawing. This allows a rolling force for suitably smoothing thick walled portion 6 to be imparted to inner reduction roller 21 from the slit portion of open pipe 1. The rolling force of inner reduction roller 21 is sufficient to smooth thick walled portion 6.

Figure 4:
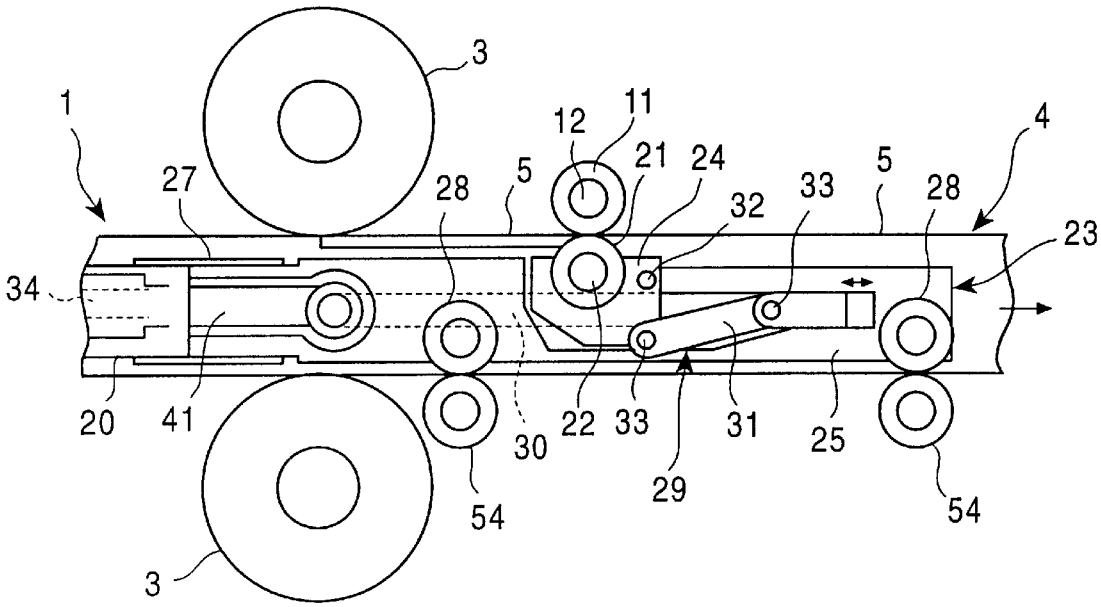
FIG. 4 is an enlarged view of the right hand portion of FIG. 3.

In this embodiment, when connecting rod 41 is moved backward (moved to the tail end side) by moving forward cylinder rod 45, link lever 31 is rotated in the clockwise direction about movable pin 33 on the side of link arm 30, and bearing 24 is rotated in the clockwise direction about fixed pin 32 in FIG. 4, inner reduction roller 21 is pressed toward thick walled portion 6. The rolling force corresponds to the advance distance of cylinder rod 45.

Figure 3:
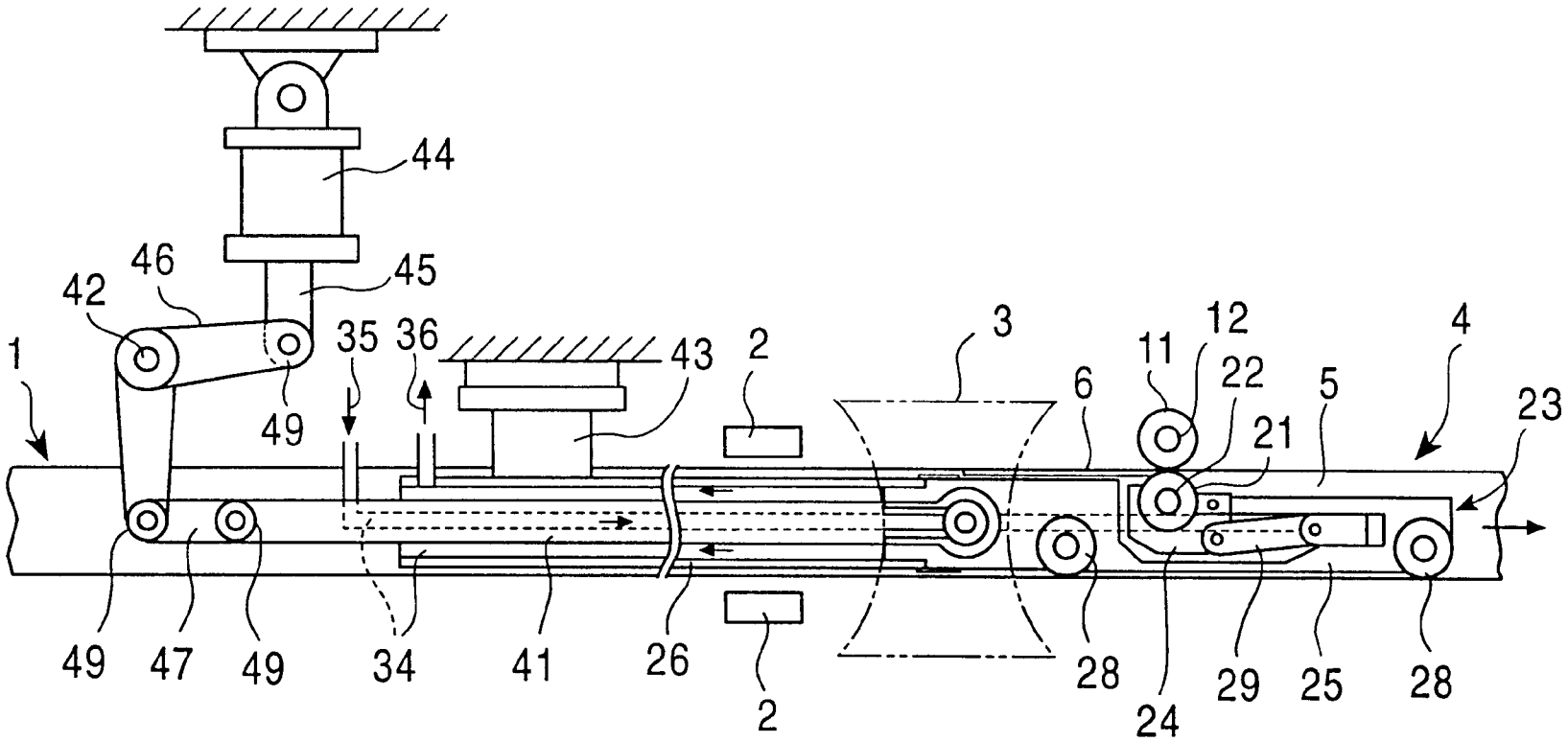
FIG. 3 is a schematic side sectional view showing a smoothing apparatus according to a third embodiment of the present invention.

Receiving rollers 28 shown in FIGS. 3 and 4 receive the rolling reaction force to press the pipe wall. When steel pipe 4 has a low rigidity and there is a risk of deforming the pipe body, guide rollers 54 for imparting a reaction force to receiving rollers 28 through the pipe wall may be preferably provided, as shown in FIG. 4.

In addition, it is economical to use steel as a material for support device 23. However, since rod portion 26 is placed within the magnetic field influence area of work coil 2, it is highly possible that an induced current flows will heat and soften support device 23. Thus, water passage 34 is provided inside frame portion 25 and rod portion 26 to provide a flow of cooling water, as shown in FIG. 3. Referring to FIG. 3, water passage 34 is a double structure such that connecting rod 41 serves as advance passages 35 and rod portion 26 serves as return passages 36. The cooling water is fed from the tail end to advance passage 35 that communicates with return passages pipe 36 at the front end, and the cooling water is discharged at the tail end.

In addition, squeeze roll 3 is preferably placed so as to abut welded seam 5, as shown in FIG. 4. The generation of thick walled portion 6 outside the pipe can be avoided by allowing squeeze roll 3 to abut thick walled portion 6, thereby reducing the load on outer reduction roller 11.

Figure 5A:
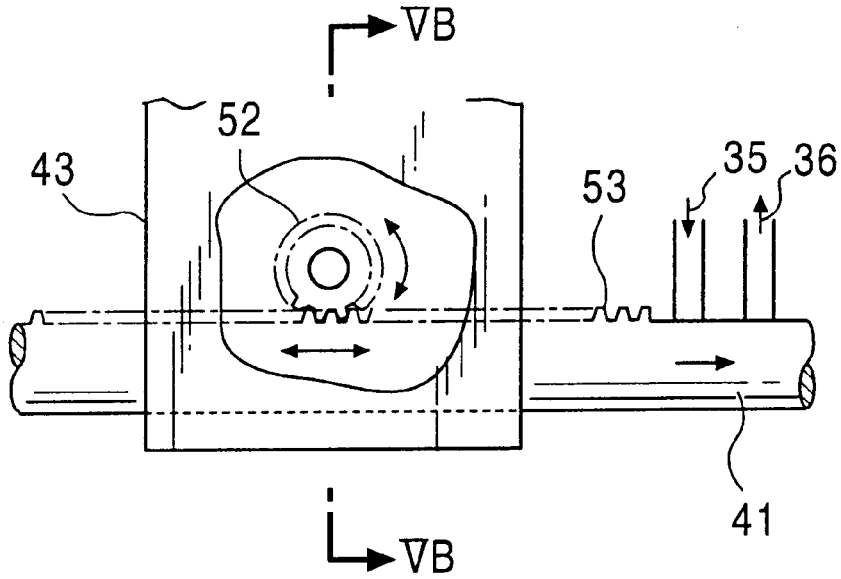
FIG. 5A is a schematic side sectional view showing a device for moving an inner reduction roller in the pipe axial direction in a smoothing apparatus according to a fourth embodiment of the present invention.
Figure 5B:
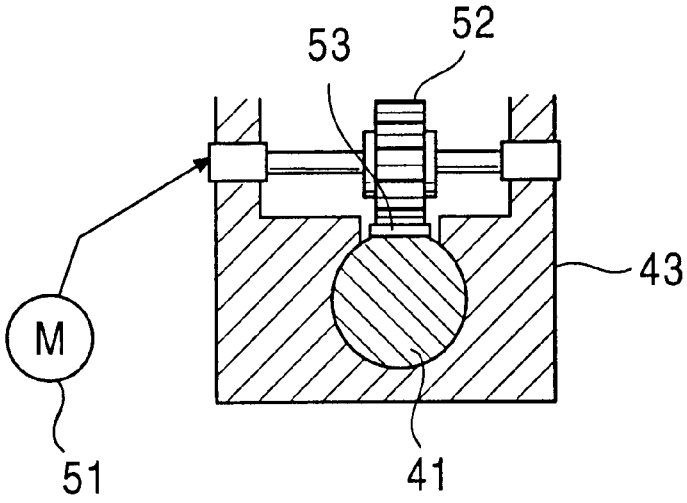
FIG. 5B is a front sectional view of FIG. 5A taken along the line A—A.

A fourth embodiment of the smoothing apparatus according to the present invention will be now be described with reference to FIGS. 5A and 5B. In this embodiment, the smoothing apparatus is provided with a device for moving pipe-inner-surface reduction roller 21 shown in FIG. 1 or 3 in the pipe axial direction.

Support device 23 having inner reduction roller 21 mounted thereon is connected to connecting rod 41 by coupler 42, and connecting rod 41 is attached to anchor 43. A guide tooth 53 extending in the pipe axial direction is provided on the outer surface of connecting rod 41, and a drive gear 52 is meshed with the guide tooth 53. Drive gear 52 is connected to a motor 51, and allows inner reduction roller 21 to move by moving connecting rod 41 in the pipe axial direction. Advance passage 35 and return passage 36 are provided inside connecting rod 41.

Since thick walled portion 6 can be easily smoothed by being depressed at higher temperature, outer and inner reduction rollers 11 and 21 are placed as close as possible to squeeze roll 3. Outer and inner reduction rollers 11 and 21 may be preferably placed on the outgoing side of squeeze roll 3 where the temperature of welded seam 5 is not lower than about 900° C.

Figure 6:
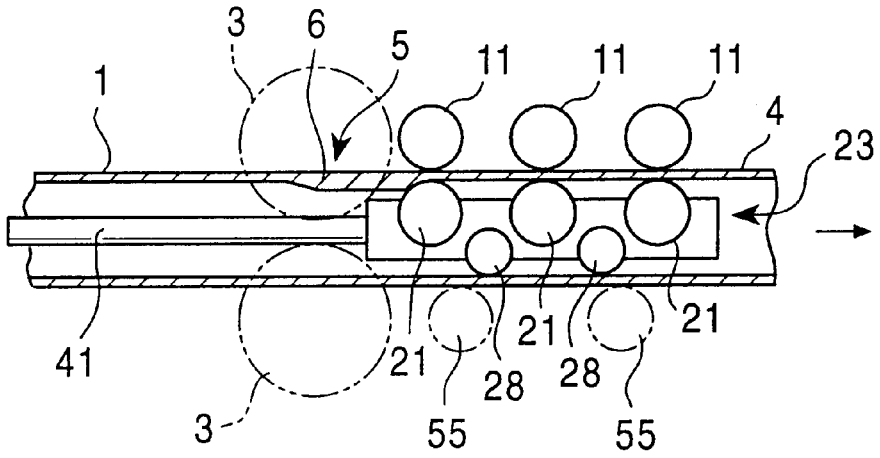
FIG. 6 is a schematic side sectional view showing a smoothing apparatus according to a fifth embodiment of the present invention.

A fifth embodiment of the smoothing apparatus according to the present invention will now be described with reference to FIG. 6. FIG. 6 is a side sectional view of a smoothing apparatus in which outer and inner reduction rollers 11 and 21 are arranged in tandem in the pipe axial direction.

As shown in FIG. 6, a plurality of outer reduction rollers 11 are arranged on the outer surface of the pipe downstream of squeeze roll 3. In addition, a plurality of inner-surface reduction rollers 21 are arranged at positions where they can oppose outer reduction rollers 11 with thick walled portion 6 provided therebetween, and are rotatably mounted on support device 23. With this arrangement, the load on one roller can be reduced. In addition, the size of support device 23 can be reduced, so that the smoothing apparatus can be applied to a welded steel pipe of a small outside diameter. Further, by arranging respective sets of outer and inner reduction rollers 11 and 21 in such a manner that they are staggered in the pipe circumferential direction, thick walled portion 6 can be positively rolled without increasing the width of the rollers even if thick walled portion 6 winds more or less.

Figure 7:
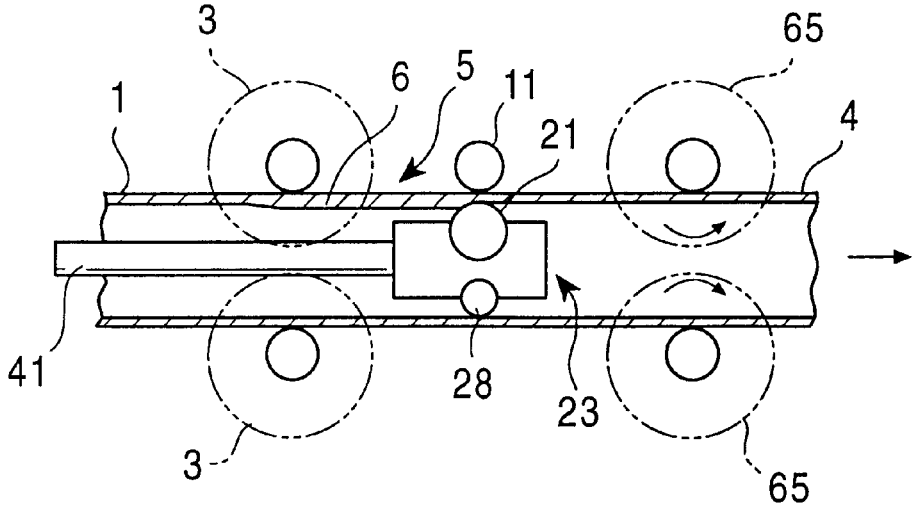
FIG. 7 is a schematic side sectional view showing a smoothing apparatus according to a sixth embodiment of the present invention.

A sixth embodiment of the smoothing apparatus according to the present invention will now be described with reference to FIG. 7. In this embodiment, the smoothing apparatus includes support device 23 placed in the pipe on the outgoing side of squeeze roll 3, inner reduction roller 21 supported by support device 23 to smooth thick walled portion 6, outer reduction rollers 11 opposing inner reduction roller 21 through welded seam 5, and pinch rollers 65 which are rotated near the downstream of outer reduction roller 11 by abutment with the outer surface of the pipe to impart a longitudinal tensile force to steel pipe 4. To impart the longitudinal tensile force to steel pipe 4, pinch rollers 65 may be rotated at a peripheral velocity higher than that of squeeze roll 3 to advance steel pipe 4. Imparting the longitudinal tensile force to steel pipe 4 stimulates a longitudinal flow of metal, thereby preventing the generation of a stepped portion in the thick walled portion 6.

Figure 8A:
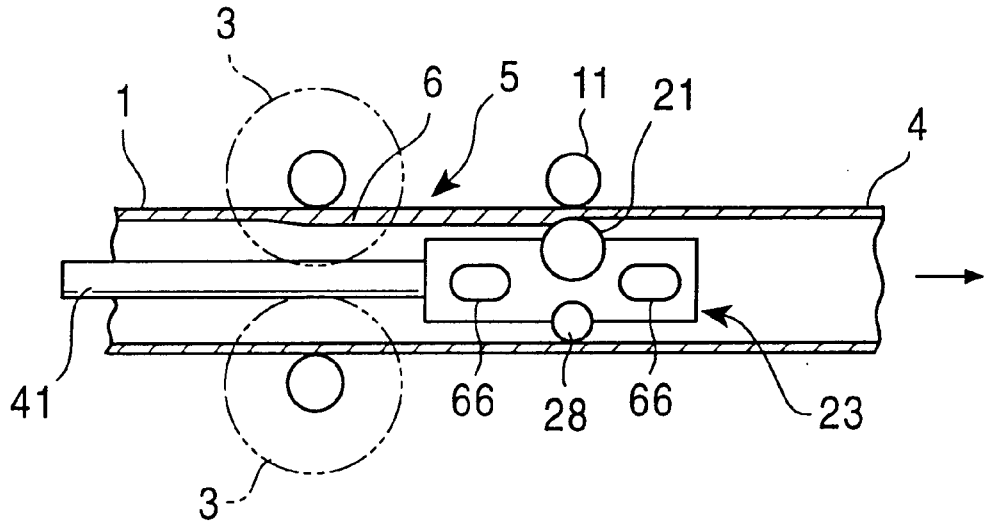
FIG. 8A is a schematic side sectional view showing a smoothing apparatus according to a seventh embodiment of the present invention.
Figure 8B:
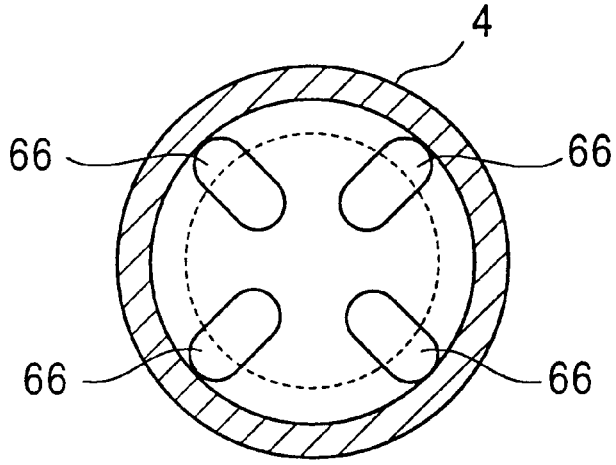
FIG. 8B is a front sectional view of FIG. 8A.

A seventh embodiment of the smoothing apparatus according to the present invention will now be described with reference to FIGS. 8A and 8B. In this embodiment, the smoothing apparatus includes support device 23 placed in the pipe on the outgoing side of squeeze roll 3, inner reduction roller 21 supported by support device 23 to smooth thick walled portion 6, and outer reduction rollers 11 opposing inner reduction roller 21 through welded seam 5. In addition, the apparatus includes a plurality of inner pressing rollers 66 provided on support device 23 near inner reduction roller 21 for pressing the inner surface of the pipe to impart a circumferential tensile force to steel pipe 4. Pressing forces of inner pressing rollers 66 can be imparted by, for example, a hydraulic cylinder through support device 23. Imparting the longitudinal tensile force to steel pipe 4 stimulates a longitudinal flow of metal, thereby preventing the generation of a stepped portion in thick walled portion 6.

Figure 9A:
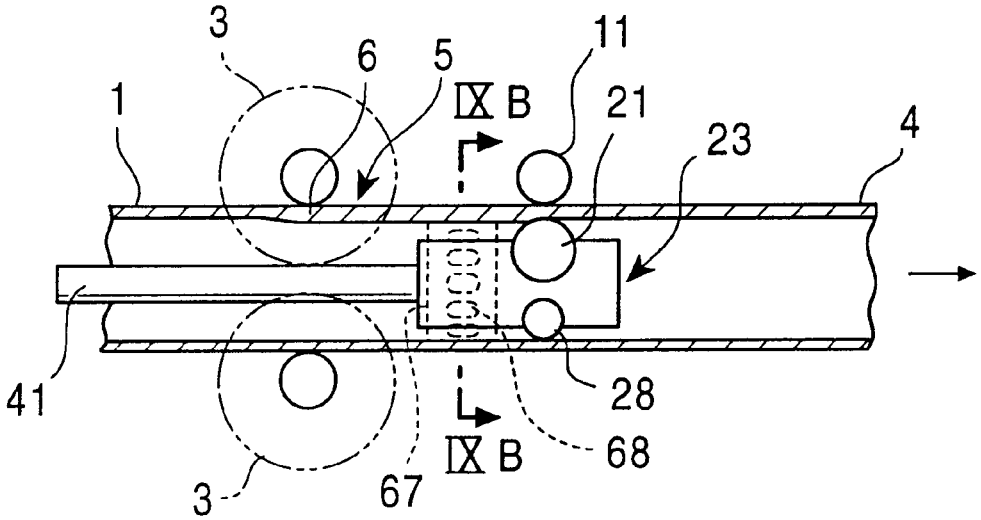
FIG. 9A is a schematic side sectional view of a smoothing apparatus according to an eighth embodiment of the present invention.
Figure 9B:
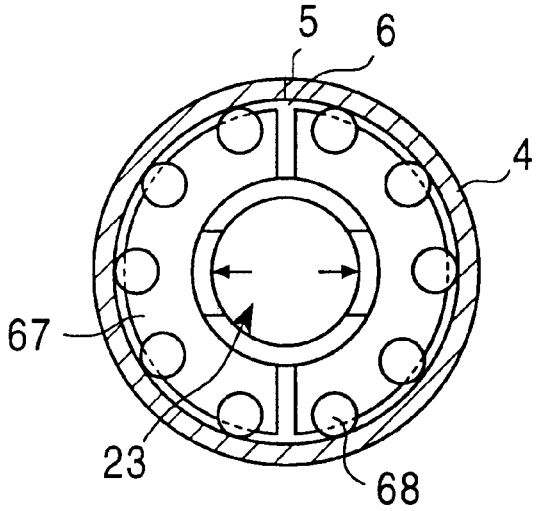
FIG. 9B is a front sectional view of FIG. 9A taken along the line A—A.

An eighth embodiment of the smoothing apparatus according to the present invention will now be described with reference to FIGS. 9A and 9B. In this embodiment, the smoothing apparatus includes support device 23 placed in the pipe on the outgoing side of squeeze roll 3, inner reduction roller 21 supported by support device 23 to smooth thick walled portion 6, and outer reduction rollers 11 opposing inner reduction roller 21 through welded seam 5. In addition, the smoothing apparatus includes a pipe-expanding tool 67 supported by support device 23 to expand the pipe circumference by pressing the inner surface of the pipe on the outgoing side of squeeze roll 3. Pipe-expanding tool 67 includes rollers 68 to prevent the generation of inner surface flaws due to rubbing against the inner surface of the pipe. A pressing force of pipe-expanding tool 67 can be imparted by, for example, a hydraulic cylinder through support device 23. This allows welded seam 5 to be pulled in the circumferential direction and subjected to inner surface rolling after thick walled portion 6 is plastically deformed to reduce its thickness, so that the collapsed volume is reduced and the welded seam can be smoothed.

In the apparatus for smoothing the welded seam of steel pipe described above, when the outside diameter of steel pipe 4 is changed, outer reduction roller 11, inner reduction roller 21, support device 23 and so forth provided downstream of coupler 42 may be replaced with those having the size corresponding to the outside diameter after replacement.

When thick walled portion 6 is rolled by outer reduction roller 11 and inner reduction roller 21, a bending stress of 15 kg/mm or more is generated by a reaction force from the pipe. In addition, the temperature difference between an area near the pressure-welded point of the surface of the roller abutting the pipe and other areas frequently reaches 150° C. or higher.

Therefore, in order to extend the life of the rollers, the materials for the rollers may be preferably selected from those having a bending strength of 150 $kg/mm^2$ or more, and a heat shock-resistant temperature difference of 150° C. or higher. The heat shock-resistant temperature difference refers to the temperature difference which does not produce cracking in a test piece of a square bar of 3 mm×4 mm×40 mm (the specification for JIS four-point bending test) when the sample is dropped into water after being heated to a predetermined temperature (the difference between the heating temperature and the water temperature).

In light of the present levels of technology, silicon nitride ($Si_3N_4$) based ceramics, silicon carbide (SiC) based ceramics, zirconium oxide ($ZrO_2$) based ceramics, or aluminum oxide ($Al_2O_3$) based ceramics are most desirable for the materials.

A method of producing welded steel pipes according to the present invention will now be described.

The method according to the present invention may include the steps of successively subjecting a steel strip to shaping with a forming roll to obtain an open pipe, heating two opposite longitudinal edges of the open pipe to a temperature range below the melting point by means of induction heating, and pressure-welding two opposite longitudinal edges of the open pipe by a squeeze roll, wherein edge ends to be inner surfaces of two opposite longitudinal edges of the open pipe are preformed before the pressure-welding by the squeeze roll. Thereafter, a thick walled portion is smoothed by a smoothing apparatus.

Figure 10A:
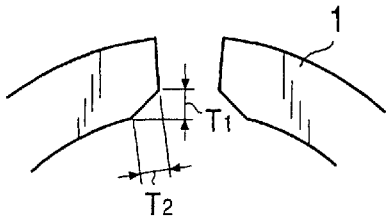
FIGS. 10A and 10B are sectional views each showing an example of the preformed shape of both edges of an open pipe.
Figure 10B:
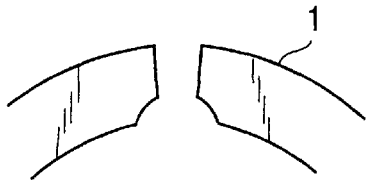
Figure 11:
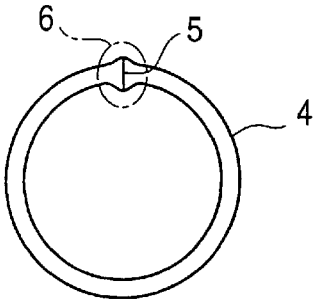
FIG. 11 is an illustration showing a state of thick walled portion generated on a weld seam.
Figure 12:
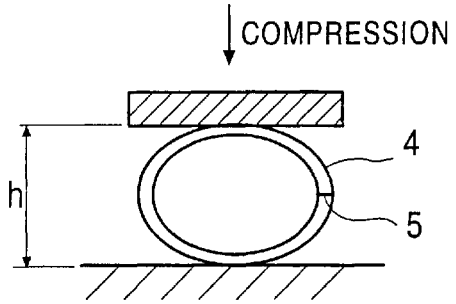
FIG. 12 is an illustration of a flattening test procedure.

In this case, and with reference to FIGS. 10A and 10B, the edge ends that are to be inner surfaces of two opposite longitudinal edges of the open pipe are chamfered by an edge roll or cutting before the pressure-welding by the squeeze roll. The preformed shape of the preformed edge ends is not necessarily restricted to this shape, and the inside ends of two opposite longitudinal edges may be chamfered into a tapered shape, or a round shape by the length of $T_1$ in the thickness direction and by the length of $T_2$ in the pipe circumferential direction.

By preforming two opposite longitudinal edges of the open pipe before the pressure-welding by the squeeze roll, the size of the thick walled portion generated during butt-welding and connection by the squeeze roll can be reduced. This can reduce the load on the smoothing apparatus and increase pipe production speed.

The present invention will be more clearly understood with reference to the following examples:

EXAMPLE 1

The smoothing apparatus shown in FIGS. 1 and 2 was installed in a steel pipe production line, and a carbon steel pipe an outside diameter of 21.7 to 60.5 mm a thickness of 1.6 to 3 mm (equivalent to SGP of JIS G3452, and STK of JIS G3444) was produced by a solid-phase pressure-welding pipe production method while smoothing thick walled portion 6.

In Example 1, silicon nitride based ceramics having a bending strength of 85 kg/mm$^2$, and a heat shock-resistant temperature difference of 800° C. were used for the materials of squeeze roll 3, outer reduction roller 11 and inner reduction roller 21 each abutting thick welded seam 6. In addition, during the operation of the apparatus of the present invention, cooling water was provided in the water passage 34 to maintain the temperature of the center portion of support device 23 at 200±15° C. The position of inner reduction roller 21 was fixed, and when the thickness of the pipe was changed, outer reduction roller 11 was moved in the steel pipe radial direction to control the spacing between inner reduction roller 21, thereby imparting a rolling force to inner reduction roller 21.

On the other hand, as a comparative example 1, a base pipe of the same specification and size was produced by a solid-phase pressure-welding pipe production method in a conventional pipe production line having squeeze rolls placed on both sides of a thick walled portion in which the welded seam was smoothed by bead cutting. Thereafter, the pipe was made by the same procedure as that of example 1.

As a result, according to the example 1, the maximum pipe producing speed during the solid-phase pressure-welding remarkably increased from 100 m/min in the comparative example 1 to 180 m/min, the seam quality (evaluated by an average value of flatness-height ratio h/D in a flattening test) remarkably increased from 0.5 (comparative example 1) to 2t/D, and the longitudinal thickness variation of the welded seam remarkably increased from −0.2 to +0.3 mm (comparative example 1) to ±0.05 mm. In addition, the surface texture was greatly improved.

EXAMPLE 2

The smoothing apparatus shown in FIGS. 3 and 4 was installed in a steel pipe production line, and a carbon steel pipe having an outside diameter of 60.5 to 114.3 mm a thickness of 1.9 to 4.5 mm (equivalent to SGP of JIS G3452, and STK of JIS G3444) was produced by a solid-phase pressure-welding pipe production method while smoothing thick walled portion 6.

In Example 2, silicon nitride based ceramics having a bending strength of 85 kg/mm$^2$, a heat shock-resistant temperature difference of 800° C. were used for the materials of the squeeze roll 3, outer reduction roller 11 and inner reduction roller 21 each abutting thick walled portion 6. In addition, during the drive of the apparatus of the present invention, cooling water was provided in water passage 34 to maintain the temperature of the center portion of support device 23 at 200±15° C. The position of outer reduction roller 11 was fixed, and when changing the thickness of the pipe, inner reduction roller 21 was moved in the steel pipe radial direction to control the spacing between outer reduction roller 21, thereby imparting a rolling force to outer reduction roller 11.

On the other hand, as a comparative example 2, a base pipe of the same specification and size was produced by a solid-phase pressure-welding pipe production method in a conventional pipe production line having squeeze rolls placed on both sides of a thick walled portion in which the welded seam was smoothed by bead cutting. Thereafter, the pipe was made by the same procedure as that of example 2.

As a result, in the example 2, the maximum pipe producing speed during the solid-phase pressure-welding remarkably increased from 100 m/min of comparative example 2 to 150 m/min, the seam quality (evaluated by an average value of flatness-height ratio h/D in a flattening test) of the product pipe remarkably increased from 0.5 (comparative example 2) to 0.2, and the longitudinal thickness variation of the welded seam remarkably increased from −0.2 to +0.3 mm (comparative example 2) to ±0.15 mm. In addition, the surface texture was greatly improved.

While preferred embodiments of the present invention have been described, it is to be understood that the invention is to be defined by the appended claims when read in light of the specification and accorded their full range of equivalence, with changes and modifications being apparent to those of skill in the art.

What is claimed is:

1. An apparatus for smoothing a thick walled portion of a steel pipe that has been made by pressure-welding two opposite longitudinal edges of an open pipe with a squeeze roll after subjecting two opposite longitudinal edges to induction heating, the apparatus comprising:

outer and inner reduction rollers for applying pressure to opposing sides of the thick walled portion from respective outer and inner surfaces of the pipe;

a support supporting said inner reduction roller to be rotatable and comprising a water passage for cooling water and a coupler at one end thereof;

a connecting rod connecting said support to said coupler and containing a further water passage in fluid communication with said water passage;

a support frame for supporting said outer reduction roller, and means for moving said support frame in the steel pipe radial direction to control the spacing between said outer and inner reduction rollers; and an anchor holding said connecting rod.

2. The apparatus of claim 1, wherein said support includes a bearing for rotatably supporting said inner reduction roller, means for generating a rolling force to be transmitted to said connecting rod and for displacing said bearing toward said outer reduction roller, and said bearing being connected to the connecting rod through a link mechanism structured and arranged to transmit the rolling force to said inner reduction roller via displacement of said bearing.

3. The apparatus of claim 1, wherein said outer and inner reduction rollers are arranged in tandem in the pipe axial direction.

4. The apparatus of claim 1, wherein the squeeze roll abuts the thick walled portion.

5. The apparatus of claim 1, further comprising guide rollers on an outer surface of the pipe for supporting said support through the pipe.

6. The apparatus of claim 1, wherein said anchor comprises means for moving said connecting rod in the pipe axial direction.

7. The apparatus of claim 1, further comprising pinch rollers for imparting a longitudinal tensile force to the pipe while rotating downstream of said outer reduction roller by abutment with the outer surface of the pipe.

8. The apparatus of claim 1, further comprising a plurality of inner surface pressing rollers for pressing the inner surface of the pipe near said inner reduction roller to impart a circumferential tensile force to the pipe.

9. The apparatus of claim 1, further comprising a pipe-expanding tool supported by said support on an outgoing side of the squeeze roll to expand the pipe circumference by pressing the inner surface of the pipe.

10. The apparatus of claim 1, wherein said inner and outer reduction rollers comprise materials having a bending strength of at least 15 kg/mm$^2$, and a heat shock-resistance temperature difference of at least 150° C.

11. The apparatus of claim 10, wherein said materials are selected from the group consisting of silicon nitride based ceramics, silicon carbide based ceramics, zirconium oxide based ceramics, and aluminum oxide based ceramics.

12. An apparatus for smoothing a thick walled portion of a steel pipe, the apparatus comprising:

outer and inner reduction rollers for applying pressure to opposing sides of the thick walled portion from respective outer and inner surfaces of the pipe;

a force generator for providing a linearly directed force;

a support supporting said inner reduction roller to be rotatable;

an axially movable connecting rod connecting said support to said force generator and for conveying the linearly directed force from said force generator to said support;

said support comprising a linkage for translating the linearly directed force to an outwardly directed radial pressure.

13. The apparatus of claim 12, wherein the linearly directed force from said force generator is generally perpendicular to an axis of said connected rod, and further comprising a link for translating the linearly directed force into axial movement of said connecting rod.

* * * * *